US007650707B2

(12) United States Patent
Campbell et al.

(10) Patent No.: US 7,650,707 B2
(45) Date of Patent: Jan. 26, 2010

(54) FLEXIBLE AND/OR LATERALLY STABLE FOOT-SUPPORT STRUCTURES AND PRODUCTS CONTAINING SUCH SUPPORT STRUCTURES

(75) Inventors: Derek Campbell, Portland, OR (US); Ryusuke Hanaka, Sakura (JP); Michael Forsey, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 662 days.

(21) Appl. No.: 11/360,993

(22) Filed: Feb. 24, 2006

(65) Prior Publication Data

US 2007/0199213 A1 Aug. 30, 2007

(51) Int. Cl.
*A43B 5/00* (2006.01)

(52) U.S. Cl. ..... 36/127; 36/102; 36/25 R; 36/142

(58) Field of Classification Search ..... 36/102, 36/25 R, 31, 103, 127, 129, 142–144
See application file for complete search history.

(56) References Cited

U.S. PATENT DOCUMENTS 1,853,990 A 4/1932 Oakley
2,211,057 A 8/1940 Duckoff
2,547,480 A 4/1951 McDaniel
2,897,611 A 8/1959 Schaller
3,311,999 A * 4/1967 Macneill ..... 36/127
4,283,865 A 8/1981 Dassler
4,307,521 A * 12/1981 Inohara et al. ..... 36/31
4,309,376 A 1/1982 Ueno et al.
4,446,634 A * 5/1984 Johnson et al. ..... 36/29
4,481,727 A 11/1984 Stubblefield
4,559,724 A * 12/1985 Norton ..... 36/129
4,624,061 A 11/1986 Wezel et al.

(Continued)

FOREIGN PATENT DOCUMENTS

DE 20 2005 013282 U1 12/2005

(Continued)

OTHER PUBLICATIONS

Partial International Search Report in corresponding PCT Application, International Application No. PCT/US2007/003418, mailed Jul. 31, 2007.

(Continued)

*Primary Examiner*—Marie Patterson
(74) *Attorney, Agent, or Firm*—Banner & Witcoff, Ltd.

(57) ABSTRACT

Support structures for footwear and the like include contact surface-contacting members (e.g., outsole structures) having an exterior surface that includes: (a) a recessed segment extending longitudinally from a forefoot to a heel portion, (b) plural lateral motion inhibiting traction elements in the lateral, forefoot portion, and (c) plural medial motion inhibiting traction elements in the lateral, heel portion. The recessed segment provides a flex line about which the medial and lateral sides of the surface-contacting member can move to independently engage and disengage from a contact surface as a wearer's weight shifts. In at least some structures, the lateral side of the foot-supporting member may be less flexible and/or more stable than the medial side. Support structures of the types described above can allow more of the surface-contacting member to remain in contact with the ground and provide a solid base or support for the movement or activity.

42 Claims, 7 Drawing Sheets

U.S. PATENT DOCUMENTS

| | | | | |
|---|---|---|---|---|
| 4,676,010 | A | 6/1987 | Cheskin | |
| 4,754,561 | A * | 7/1988 | Dufour | 36/127 |
| 4,779,361 | A | 10/1988 | Kinsaul | |
| 4,885,851 | A | 12/1989 | Peterson | |
| 5,024,007 | A | 6/1991 | DuFour | |
| 5,044,096 | A | 9/1991 | Polegato | |
| 5,709,954 | A * | 1/1998 | Lyden et al. | 428/500 |
| 5,784,808 | A * | 7/1998 | Hockerson | 36/102 |
| 5,786,057 | A * | 7/1998 | Lyden et al. | 428/52 |
| 5,806,209 | A * | 9/1998 | Crowley et al. | 36/28 |
| 5,832,636 | A | 11/1998 | Lyden et al. | |
| 5,906,872 | A | 5/1999 | Lyden et al. | |
| 5,979,083 | A * | 11/1999 | Robinson et al. | 36/127 |
| 6,016,613 | A | 1/2000 | Campbell et al. | |
| 6,065,230 | A * | 5/2000 | James | 36/25 R |
| 6,098,313 | A | 8/2000 | Skaja | |
| 6,108,943 | A | 8/2000 | Hudson et al. | |
| 6,158,151 | A * | 12/2000 | Won | 36/127 |
| 6,354,022 | B2 | 3/2002 | Gelsomini | |
| 6,357,146 | B1 | 3/2002 | Wordsworth et al. | |
| 6,457,262 | B1 * | 10/2002 | Swigart | 36/29 |
| 6,477,791 | B2 | 11/2002 | Luthi et al. | |
| 6,519,873 | B1 * | 2/2003 | Buttigieg | 36/29 |
| 6,705,027 | B1 | 3/2004 | Campbell | |
| 6,817,117 | B1 | 11/2004 | Campbell | |
| 6,857,205 | B1 | 2/2005 | Fusco et al. | |
| 6,892,479 | B2 | 5/2005 | Auger et al. | |
| 6,904,707 | B2 | 6/2005 | McMullin | |
| 6,931,768 | B2 | 8/2005 | Baek | |
| 6,948,264 | B1 | 9/2005 | Lyden | |
| 6,990,755 | B2 * | 1/2006 | Hatfield et al. | 36/97 |
| 7,181,868 | B2 | 2/2007 | Auger et al. | |
| 7,191,550 | B2 | 3/2007 | Baek | |
| 2001/0016993 | A1 | 8/2001 | Cagner | |
| 2001/0032400 | A1 | 10/2001 | Brooks | |
| 2002/0004999 | A1 * | 1/2002 | Caine et al. | 36/129 |
| 2002/0053146 | A1 * | 5/2002 | Swigart | 36/29 |
| 2002/0144429 | A1 * | 10/2002 | Hay | 36/25 R |
| 2003/0131501 | A1 | 7/2003 | Erickson et al. | |
| 2003/0188458 | A1 | 10/2003 | Kelly | |
| 2004/0148804 | A1 * | 8/2004 | Romano et al. | 36/103 |
| 2005/0076536 | A1 | 4/2005 | Hatfield et al. | |
| 2005/0108902 | A1 | 5/2005 | McMullin | |
| 2005/0150134 | A1 | 7/2005 | Issler | |
| 2005/0262739 | A1 | 12/2005 | McDonald et al. | |
| 2006/0242863 | A1 | 11/2006 | Patmore | |
| 2007/0169379 | A1 | 7/2007 | Hazenberg et al. | |
| 2007/0199211 | A1 | 8/2007 | Campbell | |
| 2008/0216352 | A1 | 9/2008 | Baucom et al. | |
| 2009/0056166 | A1 | 3/2009 | Edy et al. | |
| 2009/0056169 | A1 | 3/2009 | Robinson, Jr. et al. | |

FOREIGN PATENT DOCUMENTS

| | | |
|---|---|---|
| WO | 2006016254 | 2/2006 |

OTHER PUBLICATIONS

International Preliminary Report on Patentability issued in corresponding PCT Application, International Application No. PCT/US2007/003418, mailed Sep. 4, 2008.

* cited by examiner

FLEXIBLE AND/OR LATERALLY STABLE FOOT-SUPPORT STRUCTURES AND PRODUCTS CONTAINING SUCH SUPPORT STRUCTURES

FIELD OF THE INVENTION

This invention relates generally to flexible and/or laterally stable support structures useful in articles of footwear and other foot-receiving device products.

BACKGROUND

Conventional articles of footwear, including athletic footwear, have included two primary elements, namely an upper member and a sole structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and a contact surface (which may include any foot or footwear contact surface, including but not limited to: ground, grass, dirt, sand, snow, ice, tile, flooring, carpeting, synthetic grass, artificial turf, and the like). In addition to attenuating contact surface reaction forces, the sole structure may provide traction and help control foot motion, such as pronation. Accordingly, the upper member and the sole structure operate cooperatively to provide a comfortable structure that is suited for a variety of ambulatory activities, such as walling and running.

The sole structure of athletic footwear, in at least some instances, will exhibit a layered configuration that includes a comfort-enhancing insole, a resilient midsole (e.g., formed, at least in part, from a polymer foam material), and a contact surface-contacting outsole that provides both abrasion-resistance and traction. The midsole, in at least some instances, will be the primary sole structure element that attenuates contact surface reaction forces and controls foot motion. Suitable polymer foam materials for at least portions of the midsole include ethylvinylacetate ("EVA") or polyurethane ("PU") that compress resiliently under an applied load to attenuate contact surface reaction forces. Conventional polymer foam materials are resiliently compressible, in part, due to the inclusion of a plurality of open or closed cells that define an inner volume substantially displaced by gas.

SUMMARY

The following presents a general summary of aspects of this invention in order to provide a basic understanding of at least some aspects of the invention. This summary is not an extensive overview of the invention. It is not intended to identify key or critical elements of the invention or to delineate the scope of the invention. The following summary merely presents some concepts relating to the invention in a general form as a prelude to the more detailed description provided below.

Aspects of this invention relate to foot support elements and products in which they are used (such as support structures for footwear or other foot-receiving device products, and the like). Foot-supporting members (e.g., sole structures and/or portions thereof) for foot-receiving device products (e.g., articles of footwear, including athletic footwear) in accordance with at least some examples of this invention may include a contact surface-contacting member (e.g., an outsole structure) having a first major (exterior) surface and a second major (interior) surface. The first major surface in accordance with at least some examples of this invention may include: (a) a first recessed segment extending toward the second major surface and in a longitudinal direction from a forefoot portion to a heel portion of the contact surface-contacting member to thereby divide the contact-surface contacting member into a lateral side and a medial side, (b) plural lateral motion inhibiting traction elements extending from the first major surface in the forefoot portion of the lateral side of the contact surface-contacting member, and (c) plural medial motion inhibiting traction elements extending from the first major surface in the heel portion of the lateral side of the contact surface-contacting member. The first recessed segment may provide a line of flex in the contact surface-contacting member, wherein the medial and lateral sides are movable about the line of flex to independently engage and disengage from a contact surface as a dynamic force moves laterally across the second major surface. Also, if desired, recessed segment(s) and/or line(s) of flex may be provided in the support member generally running in the lateral direction. Additionally or alternatively, in accordance with at least some examples of this invention, the lateral side of the foot-supporting member may be made less flexible and/or more stable than its medial side.

Support structures of the types described above can be advantageous, at least in some examples of the invention, by providing stable support during a twisting or rotational action and by allowing a wearer's foot to maintain a relatively large contact area with the contact surface as the wearer's weight shifts and/or the wearer's foot moves. For example, during a golf swing or other swinging actions and/or during a step, a wearer's weight tends to shift, e.g., moving from the medial side to the lateral side, moving from the lateral side to the medial side, moving from the front to back, and/or moving from the back to front. Support structures of the types described above can allow independent movement of the lateral and medial sides of the contact surface-contact member (e.g., independent movement or rotation about the line of flex) and/or stable support during torsional rotation around the leg or foot, to thereby allow more of the contact surface-contacting member to remain in contact with the ground and to provide a solid base or support for the swing, step, or other movement or activity.

Still additional aspects of this invention relate to foot-receiving device products, such as articles of footwear, that include foot-supporting members, e.g., of the various types described above.

BRIEF DESCRIPTION OF THE DRAWINGS

A more complete understanding of the present invention and certain advantages thereof may be acquired by referring to the following detailed description in consideration with the accompanying drawings, in which like reference numbers indicate like features, and wherein.

DETAILED DESCRIPTION

Figure 1A:
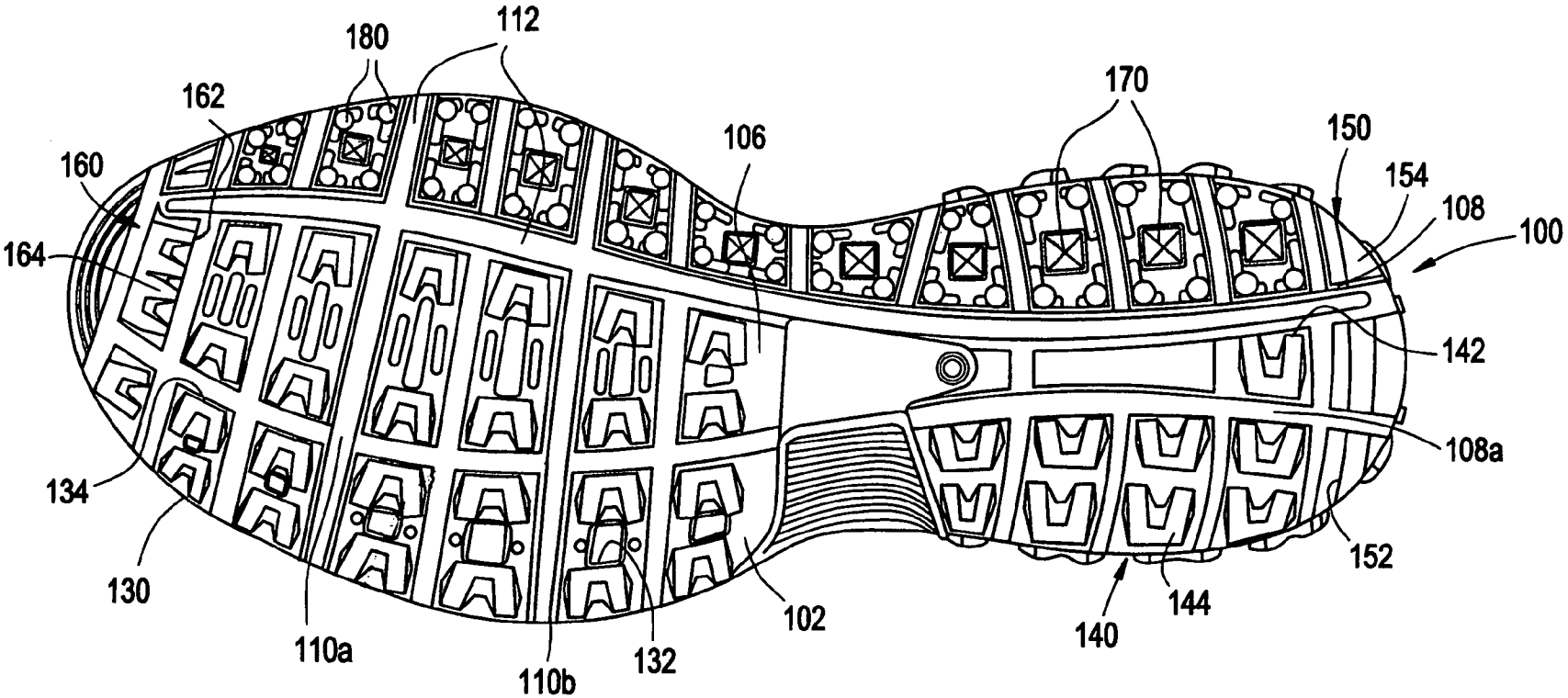
FIG. 1A illustrates a bottom (exterior) plan view of a sole structure according to at least some examples of this invention.

In the following description of various examples of the invention, reference is made to the accompanying drawings, which form a part hereof, and in which are shown by way of illustration various example structures and environments in which aspects of the invention may be practiced. It is to be understood that other specific arrangements of parts, example structures, and environments may be utilized and structural and functional modifications may be made without departing from the scope of the present invention.

Also, while the terms "top," "bottom," "side," "front," "back," "above," "below," "under," "over," and the like may be used in this specification to describe various example features and elements of structures according to the invention, these terms are used herein as a matter of convenience, e.g., based on the example orientations shown in the figures and/or a typical orientation during use. Nothing in this specification should be construed as requiring a specific three dimensional orientation of structures in order to fall within the scope of this invention.

To assist the reader, this specification is broken into various subsections, as follows:

Terms; General Background Information Relating to the Invention; General Description of Foot Support Structures and Associated Products According to the Invention; Specific Examples of the Invention; and Conclusion.

A. Terms

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like. "Footwear" may protect the feet from the environment and/or enhance a wearer's performance (e.g., physically, physiologically, medically, etc.).

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Contact surface-contacting elements" or "members" include at least some portions of a foot-receiving device structure that contact the ground or any other surface in use, and/or at least some portions of a foot-receiving device structure that engage another element or structure in use. Such "contact surface-contacting elements" may include, for example, but are not limited to, outsole elements provided in some conventional footwear products. "Contact surface-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. General Background Information Relating to the Invention

During a golf swing (or other swinging activities), a player's weight tends to shift as the club or other object is swung. For example, during a typical golf swing, several weight shifts and center of gravity position changes occur. More specifically, at the ball address position of the golf swing (prior to initiation of the swing), the golfer's weight tends to be relatively centered on the balls of his/her feet, perhaps with the weight or center of gravity located slightly more toward the front foot than the rear foot. As the golf swing begins, the golfer takes the club back (during the backswing), which tends to move weight away from the front foot and predominantly toward the rear foot. In many instances, at the top of the backswing, the majority of the golfer's weight will be located on the lateral (outside) of the rear forefoot portion and/or on the heel portion of the rear foot (optionally, at least in some instances, the weight may be somewhat on the medial (inside) of the rear foot heel).

As the swing transitions from backswing to downswing, a rotational or torsional force may be applied to the rear foot (e.g., rotation about an axis extending through the leg or foot) as the player pushes off with the rear foot and leg and the player's weight shifts toward his/her front foot. By the impact position (when the club head again reaches the ball), the player's weight typically has almost completely shifted to his/her front foot (and particularly to the lateral side of the front foot), both at the heel portion of the front foot and the forefoot portion of the front foot (e.g., with a significant amount of weight applied approximately at the fifth metatarsophalangeal area of the front foot). Little weight may be present on the rear foot at this impact position, and in fact, in many instances for many players, at least the heel of the rear foot may have begun to lift from the ground, thereby placing whatever weight is present on the rear foot toward the toe or forefoot portion of that foot. Finally, when the club reaches the swing follow-through position (e.g., over the player's front shoulder), the weight may remain completely or at least predominantly on the front foot, particularly along the lateral heel and/or arch areas, and the rear foot may be oriented essentially vertically with only the front toe portion in contact with the ground. Some golfers actually may be able to freely lift up the rear foot without losing balance when in the final follow-through position.

Because of the weight shift and/or center of gravity location change features of the typical golf swing, golf shoes typically have included spikes, cleats, or other types of traction elements, in an effort to provide traction and support for the player during a swing. While helpful, such traction elements can be of limited value, particularly as the player's foot begins to lose contact with the ground (e.g., as the player pushes against the rear foot during the beginning of the downswing, as the player rolls forward on the front foot immediately before, during, and after contact with the ball, during the follow through, etc.). In other words, spikes, cleats, or other traction elements cannot help provide traction or support when they are not in contact with the ground.

At least some aspects of the present invention help improve traction and provide a stable and solid support for wearers during swings, steps, and/or other weight shifting activities.

C. General Description of Foot Support Structures and Associated Products According to the Invention 1. Foot Support Structures Including Features According to the Invention In general, aspects of this invention relate to foot support elements and products in which they are used (such as support structures for footwear or other foot-receiving device products). Foot-supporting members (e.g., sole structures and/or portions thereof) for foot-receiving device products (e.g., articles of footwear, including athletic footwear) in accordance with at least some examples of this invention may include a contact surface-contacting member (e.g., an outsole structure) having a first major (exterior) surface and a second major (interior) surface. The first major surface in accordance with at least some examples of this invention may include: (a) a first recessed segment extending toward the second major surface and in a longitudinal direction from a forefoot portion to a heel portion of the contact surface-contacting member to thereby divide the contact-surface contacting member into a lateral side and a medial side, (b) plural lateral motion inhibiting traction elements extending from the first major surface in the forefoot portion of the lateral side of the contact surface-contacting member, and (c) plural medial motion inhibiting traction elements extending from the first major surface in the heel portion of the lateral side of the contact surface-contacting member. The first recessed segment may provide a line of flex in the contact surface-contacting member, wherein the medial and lateral sides are movable about the line of flex to independently engage and disengage from a contact surface as a dynamic force moves laterally across the second major surface (e.g., as a user shifts his/her weight while wearing an article of footwear including such a support structure).

Additionally, foot-supporting members (e.g., sole structures and/or portions thereof) for foot-receiving device products (e.g., articles of footwear, including athletic footwear) in accordance with at least some examples of this invention may provide a lateral side that is made less flexible and/or more stable than its medial side. Foot-supporting members of this type further may include a contact surface-contacting member (e.g., an outsole structure) having a first major (exterior) surface and a second major (interior) surface, wherein the first major surface includes a first recessed segment extending toward the second major surface and in a longitudinal direction from a forefoot portion to a heel portion of the contact surface-contacting member. Again, this first recessed segment may provide a line of flex in the contact surface-contacting member, wherein the medial and lateral sides of the contact surface-contacting member are movable about the line of flex to independently engage and disengage from a contact surface as a dynamic force moves laterally across the second major surface (e.g., as a wearer's weight shifts).

The lateral side of the foot-supporting member may be made less flexible and/or more stable than its medial side in many different ways without departing from this invention. For example, in foot-supporting member structures in which one or more impact-attenuating members or structures are provided and engaged with the contact-surface contacting member (such as a midsole member, a heel-cage unit, a heel unit including a gas-filled bladder, etc.), one or more of the impact-attenuating members may be less flexible and/or more stable on the lateral side as compared to its medial side (e.g., by providing additional support structures on the lateral side; by providing a more reinforced heel unit cage or gas-bladder retaining structure on the lateral side; by providing openings or discontinuities in a foam, cage, retaining structure, or other support material on the medial side; by altering a density or stiffness of a foam or other impact-attenuating material on the lateral side as compared to the medial side, etc.). Other example ways of making the foot-supporting member less flexible and/or more stable on the lateral side as compared to its medial side include: constructing at least a portion of the lateral side of the contact surface-contacting member from a material that is more stable and/or less flexible than a material from which at least a portion of the medial side of the contact surface-contacting member is constructed; engaging an auxiliary support element with the lateral side of the contact surface-contacting member; providing openings or discontinuities in the medial side of the contact surface-contacting member; etc. The lateral side area of increased stability and/or decreased flexibility and/or the medial side area of decreased stability and/or increased flexibility may be located in one or more of: the rear heel region, the side heel region, the arch region, the forefoot region, and/or the toe region.

Foot-supporting members according to at least some examples of this invention may include additional features or structures. For example, the contact surface-contacting member of the various foot-supporting members described above further may include plural ground penetrating traction elements, e.g., extending from the first major surface in the forefoot and/or heel portions of the medial and/or lateral sides of the contact surface-contacting member. The contact surface-contacting member further may include one or more additional recessed segments, e.g., in its forefoot or heel portions, extending in the lateral or longitudinal directions, e.g., at locations corresponding to natural foot flexibility, etc., to provide additional flexibility and lines of flex. If desired, some, some portions of, or all of the various recessed segments may be at least partially filled with another material, e.g., a material softer than a material making up a major portion of the contact surface-contacting member, to further promote the flexibility characteristics of the contact surface-contacting member's structure while preventing wearer feel of ground elements through the recessed segments, puncture of the sole structure at the recessed segments, etc.

Additionally, foot-supporting members (e.g., sole structures) according to at least some examples of this invention may include one or more impact-attenuating members (e.g., midsole structures), an innersole board structure, an insole member, a heel counter, an inflated bladder, a sock liner, traction elements, etc., engaged with the contact-surface contacting member. Such additional elements, such as the impact-attenuating members and/or the innersole board members, may include a first major surface at least partially engaged with the second major surface of the contact surface-contacting member, and a second major surface opposite its first major surface. If desired, at least the second major surface of the impact-attenuating member and/or the innersole board or other members may include one or more lines of flex, e.g., corresponding to at least some of the locations of the various recessed segments provided in the contact surface-contacting member. Moreover, if desired, a given support structure may include multiple impact-attenuating members or other structures (e.g., both a midsole and an innersole board), and if further desired, any or all of these individual members may include lines of flex, e.g., corresponding to the locations of at least some of the recessed segments.

Flexible support structures of the types described above can be advantageous, at least in some examples of the invention, by allowing a wearer's foot to maintain a relatively large contact area with the contact surface as the wearer's weight shifts and/or as the wearer's foot moves. For example, during a golf swing (or other swinging activities), weight tends to shift, e.g., the wearer's center of gravity moves from the center or medial side to the lateral side and/or moves from the lateral side to the medial side. The flexible support structures of the types described above can allow independent movement of the lateral and/or medial sides of the contact surface-contacting member (e.g., independent movement or rotation with respect to one another about the lines of flex) in at least some structures to thereby allow more of the contact surface-contacting member to remain in contact with the ground (e.g., as compared to support structures that do not include such flexibility and independently and relatively movable regions). Moreover, the increased lateral stability and/or decreased lateral flexibility as compared to the medial side's stability and/or flexibility characteristics provide excellent support and/or comfort during various swinging, twisting, or moving actions, such as actions involved in golf swings, baseball or softball swings, field hockey swings, lacrosse, walking, running, etc.

The various structural features of the support structures and the various aspects of the invention described above may be used in any desired combinations, permutations, and subcombinations without departing from the invention.

2. Foot-Receiving Device Products Including Support Structures According to the Invention Additional aspects of this invention relate to foot-receiving device products, such as articles of footwear, that include foot-supporting members, e.g., sole structures, of the various types described above. In some examples according to the invention, the foot-receiving device products may include: (a) a foot-covering member (e.g., an upper member); and (b) a foot-supporting member engaged with the foot-covering member.

Foot-supporting members in accordance with this aspect of the invention may include any or all of the following features and/or characteristics: one or more recessed segments (e.g., to provide any desired flexibility characteristics, e.g., of the various types described above); forefoot-located lateral motion inhibiting traction elements and/or heel-located medial motion inhibiting traction elements (e.g., to provide support for performing twisting and/or swinging actions as described above); increased lateral stability and/or decreased lateral flexibility as compared to the medial side's stability and/or flexibility; and/or any or all of the various features and/or structures described above.

Specific examples and structures according to the invention are described in more detail below. The reader should understand that these specific examples and structures are set forth merely to illustrate the invention, and they should not be construed as limiting the invention.

D. Specific Examples of the Invention

The various figures in this application illustrate examples of foot support members and their arrangement in foot-receiving device products according to some examples of this invention. When the same reference number appears in more than one drawing, that reference number is used consistently in this specification and the drawings to refer to the same or similar parts throughout.

FIGS. 1A through 1D illustrate various views of an example sole structure 100 (e.g., including an outsole member) according to at least some examples of this invention. The sole structure 100 of this illustrated example includes a first major surface forming an exterior, ground (or other surface) contacting member 102 and an interior major surface 104 opposite the ground-contacting member surface 102. The ground-contacting member surface 102 includes a base level 106, which, in this illustrated example, forms a generally continuous base for various features of the sole structure 100, which will be described in more detail below. The base level 106 may be relatively flat, smoothly sloped or curved (e.g., to include various conventional shoe features, like a forefoot region, an arch region, a heel region, a toe region, etc.), or otherwise shaped, without departing from this invention. The base level 106 (as well as the remainder of the sole structure 100) may be made of any desired materials without departing from this invention, including, for example, leather, synthetic rubbers, polymers (e.g., thermoplastic polyurethanes), and the like. The base level 106 also may be constructed from multiple independent and/or unconnected pieces and/or it may correspond to only a portion of the overall sole structure 100 (e.g., only the forefoot portion, excluding the toe portion, excluding the rear heel portion, etc.) without departing from this invention.

Figure 1B:
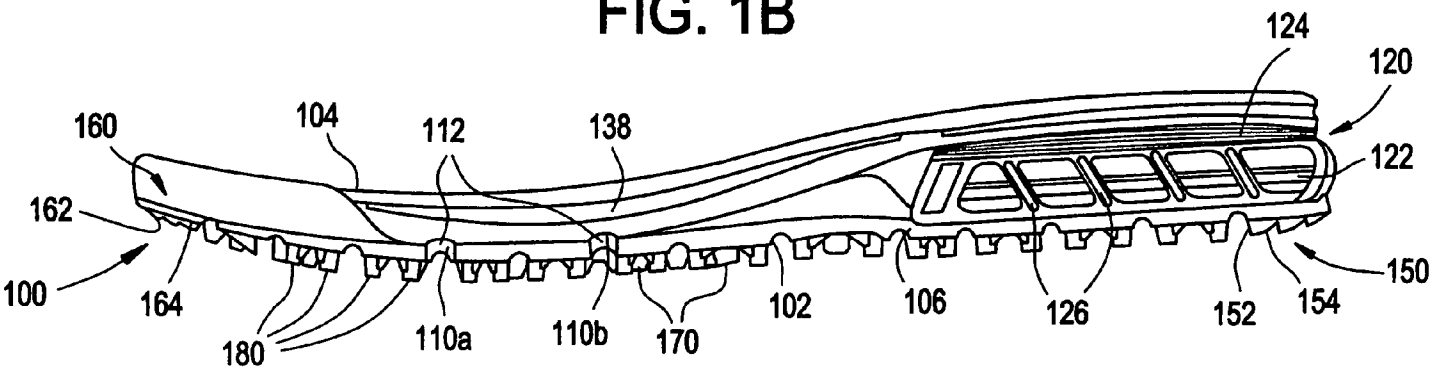
FIG. 1B illustrates a medial side view of a sole structure according to at least some examples of this invention.
Figure 1C:
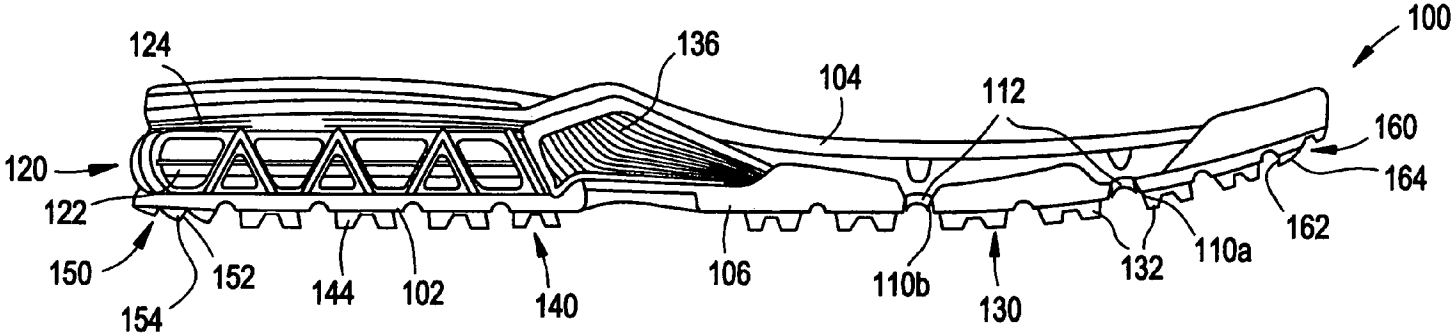
FIG. 1C illustrates a lateral side view of a sole structure according to at least some examples of this invention.

The base level 106 of this illustrated example includes at least one generally longitudinally arranged recessed segment 108 defined therein that extends from the forefoot portion (e.g., at or near the toe area of the sole structure 100) to the rearfoot portion (e.g., at or near the rear heel area of the sole structure 100). The base level 106 of this example further includes a plurality of generally laterally arranged recessed segments (e.g., segments 110*a* and 110*b*, generally and generically referred to as segments 110) defined therein. The recessed segments 108 and 110 may be provided in the sole structure 100 in any desired manner, such as during a sole member molding process, by a cutting action (e.g., using knives, lasers, etc.), and/or in any other manner, including in conventional manners known and used in the art. The recessed segments 108 and 110 in this illustrated example structure 100 provide lines of flex in the sole structure 100 and divide the sole structure 100 into various regions, such as a lateral side and a medial side. Additionally, in this example structure 100, as illustrated in FIGS. 1A through 1C, the recessed segments 108 and 110 provide thinned areas of the sole structure 100 such that at least some of the various regions (e.g., the medial side, the lateral side, the forefoot region(s), etc.) are movable or rotatable about the lines of flex 108 and 110 with respect to one another to allow the various regions to independently engage and disengage from a contact surface as a dynamic force moves laterally or longitudinally across the interior surface 104.

For example, during a golf swing (or other swinging action), as described above, a golfer may shift his or her weight laterally from the central area of the foot toward a lateral or medial side of the foot, and from there back toward the center and possibly past center and toward the other side. As the weight shifts, the sole of a wearer's shoe may tend to lose contact with the ground at various times, particularly when the wearer wears a shoe having a conventional, relatively stiff or inflexible sole structure. By providing at least one line of flex and longitudinal recessed segment 108, the sole structure 100 can flex with the wearer's foot in the interior of the shoe about the line of flex defined by the recessed segment 108 and thereby maintain a larger percentage of the sole structure 100 in contact with the ground or other contact surface for a longer time period during the course of the swing, step, or other activity. Additionally, during a golf swing (or while walking or during other activities), a wearer may shift his or her weight from the central area of the foot toward a front or rear of the foot, and from there back toward the center and possibly past center and toward the opposite end. As the weight shifts, the sole of a wearer's shoe may tend to lose contact with the ground, particularly when the wearer wears a shoe having a conventional, relatively stiff or inflexible outsole structure. By providing one or more lines of flex and the lateral recessed segments 110, the sole structure 100 can flex with the wearer's foot in the interior of the shoe about the lines of flex defined by the recessed segments 110 and thereby maintain a larger percentage of the sole structure 100 in contact with the ground or other contact surface for a longer time period during the course of the swing, step, or other activity.

While referred to as extending in the "longitudinal direction", the recessed segment(s) 108 need not extend exclusively in a direction of a longitudinal center line of the sole structure 100. Rather, as shown in FIG. 1A, the term "longitudinal direction", as used herein in this context, means that the recessed segment(s) 108 and the corresponding line(s) of flex defined thereby extend predominantly in the longitudinal direction (e.g., generally from the shoe's front toward its back), optionally in a curved manner (e.g., to correspond to the location(s) of a typical foot's lines of flex and/or flexibility in the longitudinal direction). Additionally, no individual longitudinal recessed segment 108 or line of flex need extend completely from the sole structure 100 front to its back. They may extend any desired distances. When multiple longitudinally extending recessed segments are present (e.g., segments 108 and 108*a*), the various segments need not be parallel to one another and they need not extend in precisely the same directions, in the same arch or curvature, or at the same dimensions (e.g., to the same depth in the base level, at the same width or length, etc.), as shown for example in FIG. 1A.

Similarly, while referred to as extending in the "lateral direction", the recessed segment(s) 110 need not extend exclusively in a direction laterally across the sole structure 100. Rather, as shown in the figures, the term "lateral direction", as used herein in this context, means that the recessed segment(s) 110 and the corresponding line(s) of flex defined thereby extend predominantly in the lateral direction (e.g., generally from the shoe's lateral side toward its medial side), optionally in a curved manner (e.g., to correspond to a typical foot's lines of flex and/or flexibility in the lateral direction). Additionally, if desired, it is not necessary for individual lateral recessed segments 110 or lines of flex to extend completely across the sole structure 100. They may extend any desired distances. When multiple laterally extending recessed segments 110 are present (e.g., segments 110*a* and 110*b*, additional recessed segments in the heel and forefoot portions, etc.), the various segments need not be parallel to one another and they need not extend in precisely the same directions, in the same curvature, or at the same dimensions (e.g., to the same depth in the base level 106, at the same width or length, etc.). Optionally, if desired, the lines of flex in the sole structure 100 may correspond to typical areas of flex or joints in a wearer's foot. Also, if desired, lines of flex may be provided in the heel area in at least some example sole structures 100.

The recessed segments 108 and 110 may be any desired size (e.g., length, width, and/or depth) without departing from the invention. As some more specific examples, if desired, the recessed segments may be about 1 mm to 15 mm wide and 1 mm to 10 mm deep. In some more specific examples, the recessed segments may be about 1-5 mm wide and 1-5 mm deep. Optionally, in at least some examples, the recessed segments 108 and/or 110 may be of sufficient depth to leave a thickness of 0.25-8 mm, and in some instances 1-5 mm, of base material at the bottom of the recessed segment 108 and/or 110. Of course, not all of the recessed segments in a given shoe need have the same dimensional characteristics. Additionally, the dimensions of the recessed segment(s) 108 and/or 110 may vary along the overall length, width, and/or depth of an individual segment.

If desired, some or all of the recessed segments 108 and/or 110, particularly any very deep recessed segments and/or recessed segments with a very thin layer of material (or even no material) remaining in its bottom, may be at least partially filled with another material 112 (e.g., to help prevent undesired penetration of the sole structure 100 at areas having reduced or thinned amounts of base material, to reduce wearer feel of external elements at these areas having reduced amounts of base material, etc.). The material 112 may be somewhat softer than the material making up the base layer 106. Additionally, if desired, the fill material 112 may only partially fill the recessed segments 108 and/or 110, e.g., leaving a small gap at the sides of each recessed segment 108 and 110 (e.g., the fill material 112 may be centered or otherwise positioned within the recessed segments 108 and/or 110 to leave a gap along each side) and/or a recess or slight step down in the depth direction. This gap can be useful, in at least some structures, to allow the desired flexibility characteristics identified above while still leaving the recessed segments 108 and/or 110 substantially filled to prevent the undesired penetration and feel-through characteristics also identified above. Any desired gap size (including no gap) and/or thickness of fill material 112 may be provided without departing from this invention. The fill material 112 may be provided in the recessed segments 108 and/or 110 in any desired manner without departing from the invention, such as by molding, by cements or adhesives, etc., including in conventional manners known and used in the art. As another example, if desired, the appearance of a "fill material" may be provided by simply cutting relatively narrow lines into the base layer 106, e.g., along two substantially parallel lines, to form two narrow channels and a thicker middle portion (i.e., either of the two channels form the "recessed segment" and the "fill material" is integrally formed with the base layer 106 as a one piece unit in between the channels).

As noted above, the fill material 112, when present, may be somewhat softer than the material making up the base layer 106. In this manner, the sole structure 100 remains more flexible than would be the case if the recessed segments 108 and/or 110 and fill material 112 were omitted (e.g., if a continuous, un-recessed sole structure 100 were present). Of course, any desired types of materials may be used for these structures, including rubber or polymeric materials (such as thermoplastic polyurethanes), including materials that are known and conventionally used in the art. As some more specific examples, the base layer 106 material may be constructed from a rubber material, e.g., having a hardness of 60 to 75 Shore A (and in some examples, 64 to 70 Shore A), and the fill material 112 may have about the same level of hardness, or perhaps a bit softer (optionally made from rubber or a thermoplastic polyurethane material). As additional potential examples, if desired, the fill material 112 may be a thermoplastic polyurethane ("TPU") material having a hardness in the range of 64 to 80 Shore A (e.g., in some examples, approximately 70 to 78 Shore A or even about 75 Shore A), while the base layer 106 also may be a TPU material having a higher hardness than the fill material 112, for example, in the range of 70 to 90 Shore A (e.g., in some examples, in the range of 75 to 88 Shore A or even 80 to 85 Shore A). Moreover, the entire base layer 106 need not have the same hardness. For example, if desired, the medial side (e.g., medial of the longitudinal line of flex) may be made of a harder material than the lateral side (e.g., lateral of the longitudinal line of flex) or vice versa (e.g., 75-85 Shore A or more specifically about 80 Shore A hardness for the lateral side v. 80-90 Shore A or more specifically about 85 Shore A hardness for the medial side). Of course, a wide variety of other materials, hardnesses, combinations of materials, and/or combinations of hardnesses may be used without departing from the invention. As another example, if desired, the fill material 112 may be made softer and/or more flexible than the base layer 106 by providing cuts, gaps, channels, voids, or discontinuities in the fill material 112.

The lines of flex and/or recessed segments 108 and/or 110 need not be located in the specific positions shown in FIGS. 1A through 1D in all examples of the invention. Rather, if desired, one or more lines of flex and/or recessed segments 108 and/or 110 may be provided in any one or more of the heel area, the arch area, and/or the forefoot areas without departing from the invention.

Figure 1D:
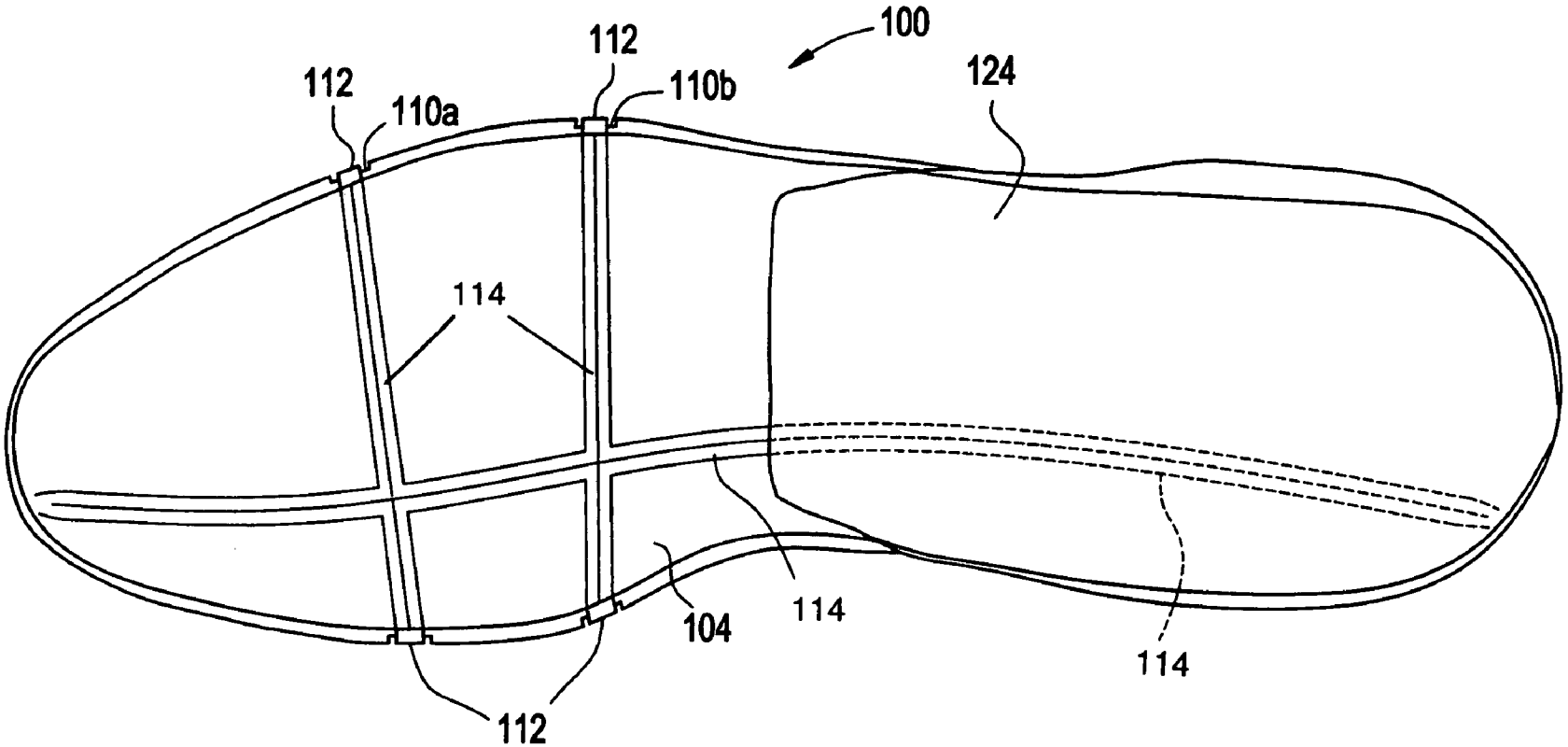
FIG. 1D illustrates a top (interior) plan view of a sole structure according to at least some examples of this invention.

FIG. 1D shows a plan view of the interior surface 104 of the sole structure 100 according to this example. As shown, the interior surface 104 includes lines of flex 114 formed therein corresponding to the locations of the recessed segments 108 and 110 on the opposite forefoot surface 102 of the sole structure. These interior lines of flex 114 can help further promote the desired flexibility characteristics of the overall sole structure 100, as described above.

FIGS. 1A through 1D illustrate other structural features of sole structures that may be present in at least some examples of this invention. For example, these figures illustrate that this example sole structure 100 includes an impact-attenuating heel unit 120 that provides additional impact-attenuation characteristics for at least the heel area of the shoe. By providing a separate impact-attenuating heel unit 120 in this example, the outsole portion of the sole structure 100 may be maintained relatively thin (e.g., 1 to 20 mm at the base layer 106 (in some examples 1.5 to 5 mm or even 2-3 mm) and 0.25 to 8 mm at the recessed portions 108 and 110 (in some examples 0.25 to 2 mm or even 0.5 to 1.5 mm)), to help preserve flexibility, while still providing adequate impact-attenuation for a comfortable walk or other activities. While any desired type of impact-attenuating heel unit 120 may be provided without departing from this invention, in this illustrated example structure 100, the heel unit 120 includes a gas-filled bladder element 122 at least partially held by or enclosed in an impact-attenuating polymeric material 124, such as a polyurethane or ethylvinylacetate material. Also, while any desired size or thickness of heel unit 120 may be provided, in this illustrated example, the overall heel unit 120 is approximately 15 mm thick at its central, heel supporting location. Gas-filled bladders 122 and/or impact-attenuating materials 124 of this type are known and used in conventional footwear products, such as in various AIR® brand footwear products available from NIKE, Inc. of Beaverton, Oreg. Alternatively, if desired, the impact-attenuating material 124 may extend to cover a major portion of the interior surface 104 of the ground-contacting member (e.g., and function as a midsole member or other impact-attenuating and/or support structure for the sole structure 100, if desired).

Of course, if desired, other types of heel units, midsole elements, or impact-attenuating elements or structures may be provided without departing from the invention, such as conventional foam or other impact-attenuating materials, columnar shock absorbing type elements (such as those commercially available in various SHOX® brand footwear products available from NIKE, Inc. of Beaverton, Oreg.), and the like. Also, if desired, the gas-filled bladder 122, shock absorbing element, or other impact-attenuating elements, when present, may be hidden within another material (such as in impact-attenuating material 124), partially hidden in such a material, or open and exposed to the external environment, without departing from this invention.

FIGS. 1B and 1C illustrate another feature that may be available in sole structures 100 (or other foot-supporting member products) according to at least some examples of this invention. More specifically, as shown in these figures, the heel unit 120 provides more support and/or is less flexible at its lateral side than at its medial side. Even more specifically, as shown in FIGS. 1B and 1C, in this illustrated example sole structure 100, the heel unit 120 includes a cage-like retaining structure 126 along the medial side (FIG. 1B) and a cage-like retaining structure 128 along the lateral side (FIG. 1C). To better support and match a golf swing (or other swinging actions), in this example sole structure 100, the cage-like retaining structures 126 and 128 are formed such that the lateral side provides more support and/or is less flexible than the medial side. This is accomplished in the illustrated structure 100 by providing more retaining structures 128 on the lateral side than on the medial side, and by forming the lateral side retaining structures 128 in more of a supporting truss-like structure (e.g., in the illustrated example, the medial retaining structures 126 are all essentially parallel to one another and spaced apart while the lateral retaining structures 128 join one another or intersect and extend in different directions, e.g., to form a triangular appearing structure). Of course, a wide variety of different retaining structure designs may be used to make the lateral side more stable and/or less flexible than the medial side.

Of course, other ways of making the lateral side more stable and/or less flexible than the medial side may be provided without departing from this invention. For example, the gas-filled bladder 122 may be designed to include support elements (e.g., plastic support elements, cross-sectional or diagonal supports, etc.) on the lateral side and/or to otherwise provide a more stable and/or less flexible lateral side; the gas-filled bladder 122 may be designed to include discontinuities, grooves, channels, or other flexible or weakening portions on the medial side as compared to the lateral side; the impact-attenuating material 124 may be made more stable on the lateral side than the medial side (e.g., by providing stiffer impact-attenuating material on the lateral side; by providing additional auxiliary support structures on the lateral side (e.g., embedded in a foam or other impact-attenuating material 124; by providing discontinuities, grooves, channels, or other weakening portions on the medial side; etc.); an additional support member may be provided with the desired support and/or flexibility characteristics (e.g., a plate between the gas-filled bladder 122 and the outsole or a midsole portion, an auxiliary support member 136 may be provided on the lateral side, an additional soft foam or other material 138 may be provided on the medial side, etc.); stiffer impact-attenuating elements (such as impact-attenuating columns of the types available in various SHOX® brand footwear products available from NIKE, Inc. of Beaverton, Oreg.) may be provided on the lateral side as compared to the medial side; more flexible impact-attenuating elements (such as impact-attenuating columns of the types available in various SHOX® brand footwear products available from NIKE, Inc. of Beaverton, Oreg.) may be provided on the medial side as compared to the lateral side; a midsole element or an inner sole board element that is, in some manner, more flexible and/or less supportive on the medial side as compared to the lateral side may be provided; etc.

Sole structures according to examples of the invention may have additional structural features that enhance their ability to provide traction, e.g., during twisting actions such as those used in golf, baseball, or softball swings; during standing, swinging, walking, running or other activities, particularly on uneven terrain; etc. Of course, any desired types of traction elements may be provided without departing from the invention, including conventional traction elements as are known and used in the art. Some more specific examples of various traction elements follow.

Sole structures 100 according to at least some examples of the invention may include traction elements specifically designed and arranged to assist in the various swinging and other activities and actions described above. In this illustrated example sole structure 100, the bottom surface 102 of the sole structure 100 includes plural traction elements that assist in performing a variety of different functions. For example, plural traction elements 130 in the forefoot area, particularly in the lateral forefoot area in this illustrated example, include a substantially perpendicular wall 132 facing the lateral side direction and a sloped wall 134 extending back from the wall 132 toward the base level 106. In this manner, the traction elements 130 provide a strong base and support to inhibit or prevent movement of the forefoot portion of the foot in the lateral direction (e.g., to provide a strong base and support during a golf downswing) while allowing relatively easy forefoot movement in the medial direction (e.g., to allow easy movement of the foot again when disengaging from the ground, when walking resumes, etc.).

The example sole structures 100 illustrated in FIGS. 1A through 1D provide a different type or orientation of traction elements 140 in the heel portion. More specifically, in this illustrated example sole structure 100, the traction elements 140 in the heel area, particularly in the lateral side of the heel area, include a substantially perpendicular wall 142 facing the medial side direction and a sloped wall 144 extending back from the wall 142 toward the base level 106. In this manner, the traction elements 140 provide a strong base and support to inhibit or prevent movement of the heel portion of the foot in the medial direction (e.g., to provide a strong base and support during a golf downswing) while allowing relatively easy heel movement in the lateral direction (e.g., to allow easy movement of the foot again when disengaging from the ground, when walking resumes, etc.).

In the illustrated example sole structure 100, at least some of the traction elements (e.g., elements 130 and 140) are designed such that at least one of their base dimensions (e.g., length or width along the base level 106) is greater than the traction element's height dimension (e.g., the distance it extends away from the base level 106). Such traction elements provide good support, ground-penetration, and/or ground-engagement properties to resist torque during a golf swing (e.g., during a downswing motion).

Still a different traction element 150 structure or orientation may be provided in the rear heel area of the sole structure 100 illustrated in FIGS. 1A through 1D. As shown, in this example structure 100, the heel area includes traction elements 150 having a substantially perpendicular wall 152 facing the footwear front with a sloped wall 154 extending back from the front wall 152. This structure and orientation helps provide traction when walking, standing, or swinging (or performing other activities) particularly on a downhill or downward slope. Additionally, another traction element 160 structure or orientation may be provided in the very front toe area of the sole structure 100. As shown in this illustrated example structure 100, the toe area includes traction elements 160 having a substantially perpendicular wall 162 facing the footwear rear with a sloped wall 164 extending forward from the wall 162. This structure and orientation helps provide traction when walking, standing, or swinging (or performing other activities) particularly on an uphill or upward slope.

As noted above, any type or arrangement of traction elements may be used without departing from the invention. Such traction elements (e.g., elements 130, 140, 150, and/or 160) may be included as part of the sole structure 100 in any desired manner without departing from the invention, such as by integrally molding them into the sole structure 100 along with other portions of the sole structure 100 (such as the base level 106), by attaching them to the sole structure (e.g., to the base level 106 by adhesives, cements, screws, clasps, retaining elements, other mechanical connectors, etc.), etc. If desired, according to at least some examples of this invention, traction elements of the types and/or in the arrangements shown in U.S. Pat. Nos. 6,817,117 and/or 6,705,027 may be used without departing from this invention. Each of these U.S. Patents is entirely incorporated herein by reference.

In this illustrated example sole structure 100, the medial side of the sole structure 100 (medial with respect to the longitudinal recessed segment 108) includes different types of traction elements from those on the lateral side. More specifically, this illustrated example sole structure 100 includes at least some traction elements 170 designed to easily penetrate the ground and provide traction and support, e.g., during at least portions of the downswing action or other portions of the swing. If desired, in at least some examples, at least some of the traction elements 170 may be designed such that their height dimension (e.g., the distance it extends away from the base level 106) is greater than the base dimensions (e.g., the length and width dimensions along the base level 106). Further, if desired, at least one side wall of the traction elements 170 (e.g., a wall extending away from the base level 106) may be substantially planar and/or perpendicular to the base level 106 and/or pointed in a desired direction, e.g., to help provide the good ground penetration and/or at least some level of torque resistance. For example, if desired, the traction elements 170 in the heel area may have a substantially planar and/or perpendicular wall facing the medial side of the shoe (e.g., similar to the direction(s) walls 142 face) and/or the traction elements 170 in the forefoot area may have a substantially planar and/or perpendicular wall facing the lateral side (e.g., similar to the direction(s) walls 132 face). Traction elements 170 also may be provided on the lateral side of the shoe, if desired. Such traction elements 170 provide good support, ground-penetration, and/or ground-engagement properties to help resist torque during a golf swing (e.g., during a downswing motion), good release properties while walking and/or resuming motion, etc.

Additionally, if desired, additional traction elements may be provided on the medial (or other) side of the sole structure 100, such as the relatively small, round traction elements 180 provided around various traction elements 170, as shown in FIGS. 1A and 1B. Such traction elements 180 can provide additional ground-penetrating traction and support. Of course, the additional traction elements 180 may be provided in any desired shape(s) and/or at any desired positions without departing from this invention.

As shown, for example, in FIG. 1A, the various recessed segments 108 and 110 divide the outsole member bottom surface 102 into a plurality of different regions, such as medial and lateral toe regions (in front of recessed segment 110*a*), medial and lateral forefoot regions (between recessed segments 110*a* and 110*b*), and medial and lateral rear regions (behind recessed segment 110*b*). These various different regions also may be divided into smaller regions and/or other regions may be provided, e.g., due to the presence of additional recessed segments. Additionally, any desired number, types, or constructions of traction elements may be provided in the various regions without departing from this invention.

Figure 2A:
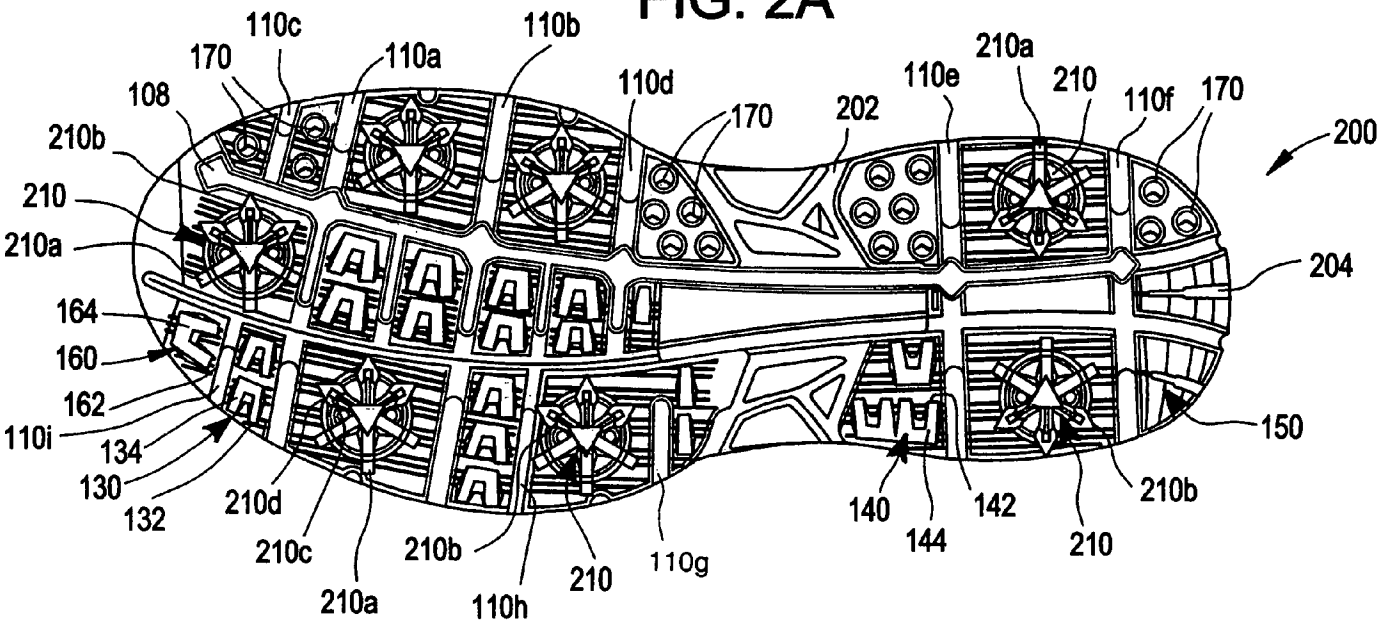
FIGS. 2A and 2B illustrate a bottom (exterior) plan view and a lateral side view, respectively, of another sole structure according to some examples of this invention.
Figure 2B:
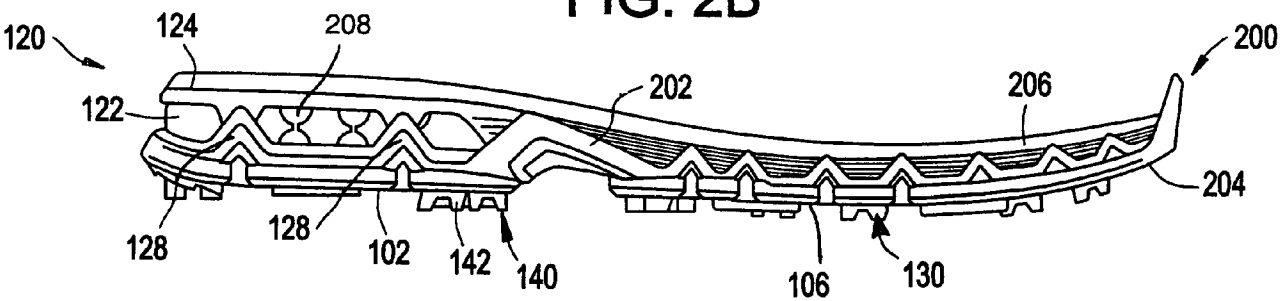

FIGS. 2A and 2B illustrate another example sole structure 200 according to at least some examples of this invention. For brevity and ease in understanding, parts with the same or similar structure and function to those shown in the example of FIGS. 1A through 1D will be labeled with the same reference numbers as used in FIGS. 1A through 1D.

The sole structure 200 of FIGS. 2A and 2B differs in various ways from the sole structure 100 illustrated in FIGS. 1A through 1D. For example, this example sole structure 200 includes several lateral recessed segments and/or lines of flex (e.g., 110*c* through 110*i*), some of which extend only partially across the sole structure 200, and these recessed segments 110 and/or lines of flex may be filled or partially filled with filling materials, e.g., of the types described above. If desired, the various lines of flex and recessed segments may be provided at locations to enhance flexibility of the sole structure and provide flexibility, particularly at locations corresponding to the foot's natural flex points.

Additionally, in this example structure 200, the lateral reinforcing structure(s) (e.g., structures used to make the lateral side more stable and/or less flexible than the medial side) extend or are provided essentially along the entire lateral side of the sole structure.

While the lateral reinforcing structure may be provided in any desired manner without departing from this invention, in this illustrated example, a support base member 202 is provided along the lateral side, e.g., between the outsole member 204 and an impact-attenuating member (such as a midsole member) or other foot-supporting or sole structure 206. Additionally, as illustrated in FIG. 2B, indentations, weld areas, or other recessed structures on the top and/or bottom surfaces of the gas-filled bladder 122 may be filled with foam or other impact-attenuating material (the fill material shown in FIG. 2B at reference number 208, e.g., the material of the midsole or other impact-attenuating member, when the foam or other material making up these members is poured, etc.).

Additionally or alternatively, if desired, any indentations, weld areas, or other recessed structures on the top and/or bottom surfaces of the gas filled bladders 122 may include additional support structures, such as plastic supports (e.g., PEBAX® (a polyether-block co-polyamide polymer available from Atofina Corporation of Puteaux, France) supports), which can help make the lateral side more stable and less flexible than the medial side. If desired, as shown in FIG. 2A, at least some and/or some portions of the recessed segments 108 and/or 110 may be structured so as to completely extend through the material of the base level 106 of the outsole member 204, e.g., such that the support base member 202 or other portion of the sole structure 200 is exposed through at least some portions of the recessed segments 108 and/or 110. If desired, the support base member 202 further may include lines of flex on its interior and/or exterior surface(s), e.g., at locations corresponding to the lines of flex of the outsole member 204 (e.g., at the locations of recessed segments 108 and/or 110). Of course, other ways of providing lateral support and/or medial flexibility may be used, in place of or in combination with the various examples described above, without departing from the invention.

The support base member 202 may be made from any desired material without departing from this invention, including conventional materials known and used in footwear construction, such as plastics (e.g., PEBAX® (a polyether-block co-polyamide polymer available from Atofina Corporation of Puteaux, France), thermoplastic polyurethanes, etc.). Also, if desired, the support base member 202 may function as a heel plate, an inner sole board, or other portion of the overall sole structure 200.

FIGS. 2A and 2B further illustrate the inclusion of additional golf spike traction elements 210 at various locations on the exterior surface 102 of the outsole member 204. Of course, any number and/or desired type of traction element 210 may be provided without departing from this invention, and such traction elements 210 may be located at any desired position(s) on the exterior surface 102. In this specific illustrated example structure 200, the traction elements 210 are arranged to provide a specific orientation when mounted to the outsole member 204, e.g., the individual traction elements are structure and mounted with relatively tall and narrow ground-penetrating members 210*a* on the lateral side of the forefoot portion and on the medial side of the heel portion and with torsion resistant members 210*b* (e.g., with a substantially perpendicular wall 210*c* and a sloping wall 210*d* as generally described with respect to traction elements 130 and 140 above) on the medial side of the forefoot portion and on the lateral side of the heel portion. These spike type traction elements 210 may be mounted to the outsole member 204 in any desired manner, including via threads, other retaining systems, etc., including through the use of conventional mounting systems that are known and used in the art.

Figure 3:
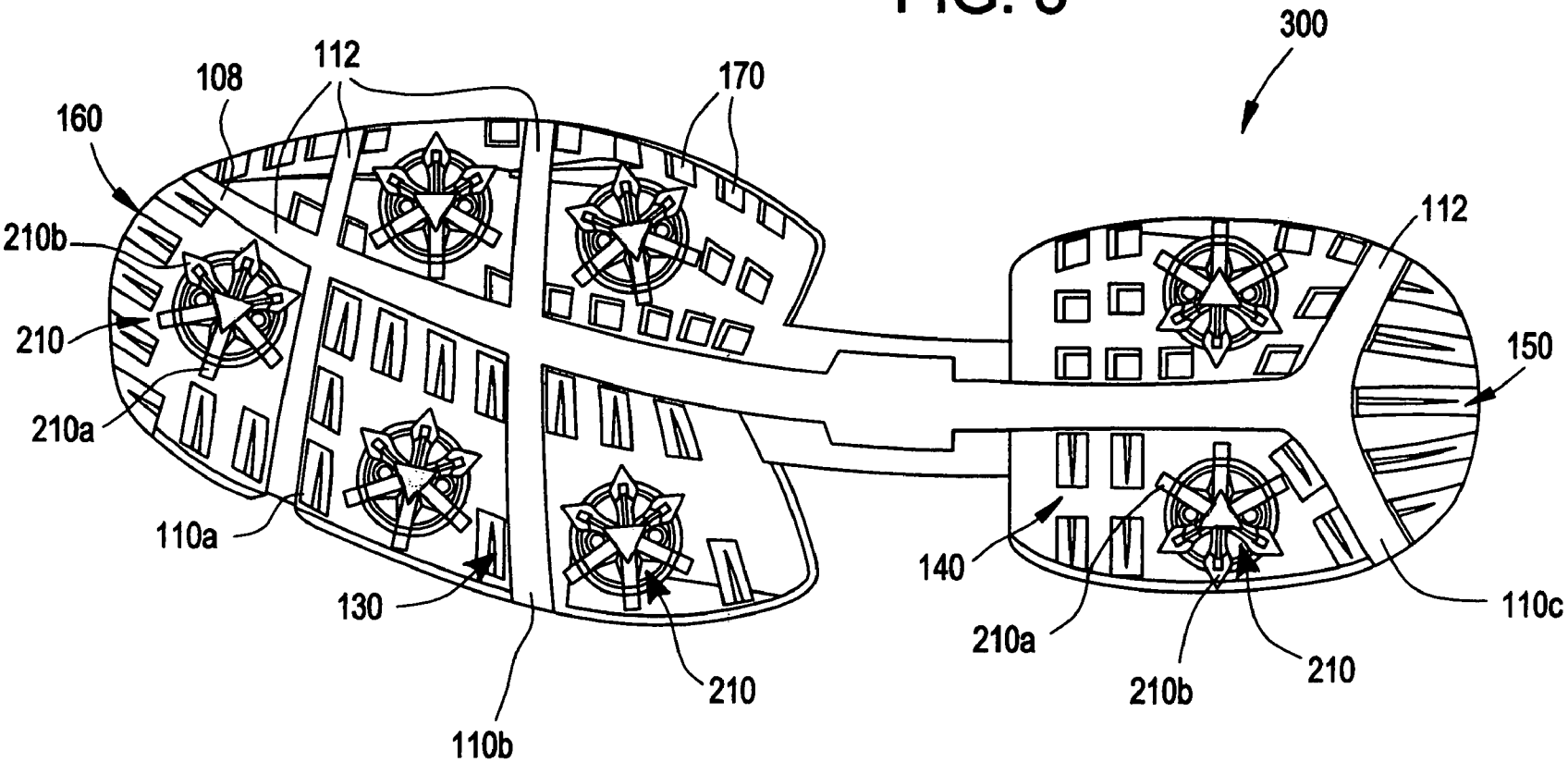
FIG. 3 illustrates a bottom (exterior) plan view of another sole structure according to some examples of this invention.
Figure 4:
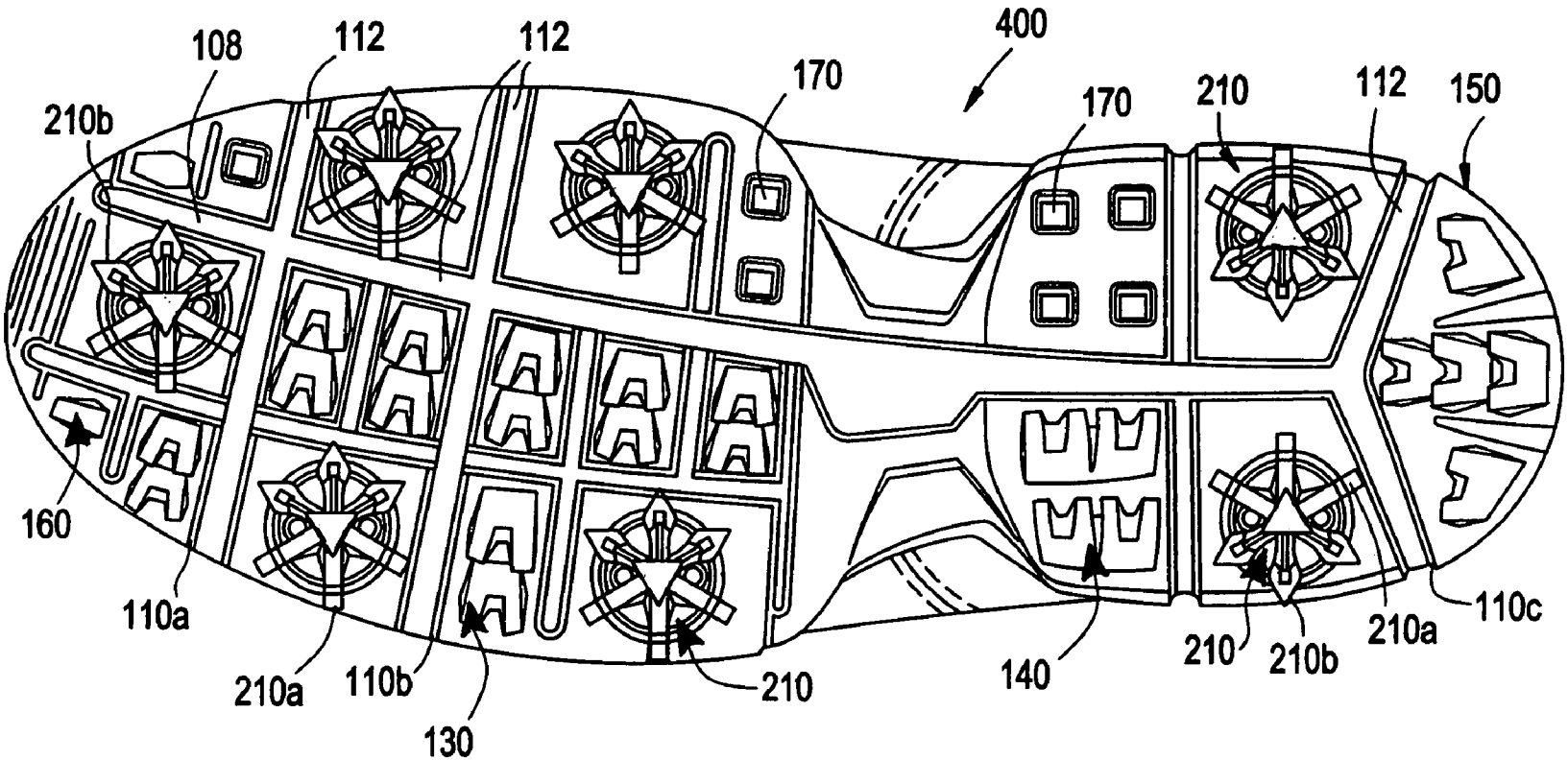
FIG. 4 illustrates a bottom (exterior) plan view of another sole structure according to some examples of this invention.

FIGS. 3 and 4 illustrate additional examples of sole structures 300 and 400, respectively, of somewhat differing designs, but that include various combinations of the features described above. In these example structures 300 and 400, a longitudinal recessed segment 108 again runs almost the entire length of the longitudinal direction of the sole structure 300 and 400 (e.g., at least 85% of the entire length in this illustrated example, and in some examples at least 90% or 95% of the entire length) and at least two forefoot arranged lateral recessed segments 110*a* and 110*b* are provided. In these example structures 300 and 400, a heel oriented lateral recessed segment 110*c* is provided that is somewhat curved (FIG. 3) or "V-shaped" (FIG. 4). Of course, if desired, separate and independent heel oriented recessed segments may be provided to replace the single segment 110*c* shown in these figures (e.g., one lateral segment extending from the lateral side to the longitudinal segment 108 and one lateral segment extending from the medial side to the longitudinal segment 108). Optionally, some, all, and/or some portions of the recessed segments 108, 11*a*, 110*b*, 110*c*, and/or others may be at least partially filled with a filler material 112, as described above. Directionally oriented spike-type traction elements 210 of the type described in conjunction with FIG. 2A (e.g., with different orientations in the heel portion v. the forefoot portion, with different types of spike claws 210*a* and 210*b*, etc.) are provided in these example structures 300 and 400, although other types of spike-type traction elements (or even no spike-type traction elements) may be provided without departing from this invention. Also, as shown, traction elements of the types designated by reference numbers 130, 140, 150, 160, and/or 170, as well as other types of traction elements, may be included in a specific sole structure 300 and/or 400 without departing from this invention.

Figure 5:
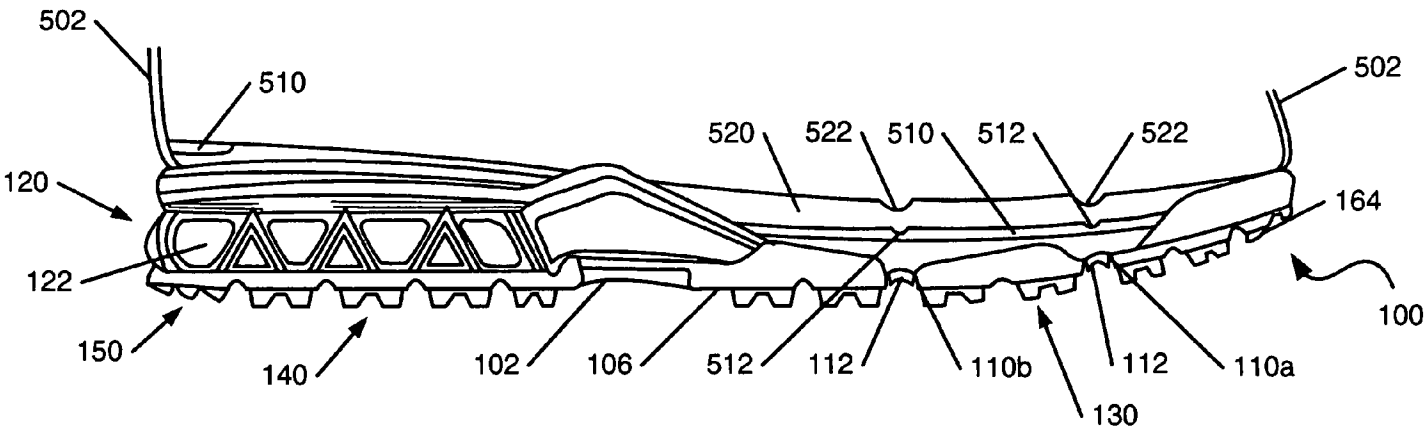
FIG. 5 illustrates a partial side view of an example article of footwear including a sole structure according to at least some examples of this invention.
Figure 5B:
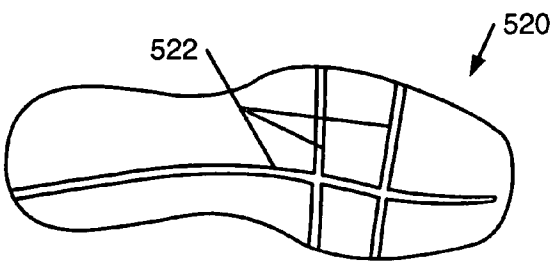
FIG. 5B illustrates a top plan view of an example midsole structure that may be included in an article of footwear according to at least some examples of this invention.
Figure 5A:
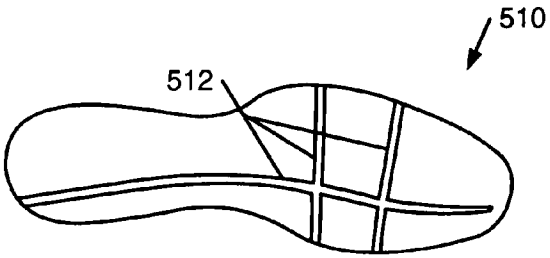
FIG. 5A illustrates a top plan view of an example innersole board structure that may be included in an article of footwear according to at least some examples of this invention.

FIG. 5 illustrates a partial side view of an example article of footwear 500 that may include a sole structure (e.g., 100, 200, 300, 400, etc.) in accordance with at least some examples of this invention. The sole structure of this example (reference number 100 used in this illustration) further may include an innersole board element 510 (see also FIG. 5A) engaged with the interior surface 104 and/or the impact-attenuating member 124 of the sole structure 100. If desired, as shown in FIGS. 5 and 5A, at least the uppermost surface of the innersole board element 510 (e.g., the surface nearest the wearer's foot) also may include lines of flex 512 (e.g., thinned regions, pre-bent, bendable, or kinked regions, open areas or discontinuities, etc.), optionally positioned to correspond to some or all of the lines of flex and recessed regions 108 and 110 of the outsole member's ground-contacting surface 102. If desired, the lower surface of the innersole board element 510 also may include lines of flex. The innersole board 510 may provide additional support, and it may be made from any desired material, such as metals, polymeric materials (e.g., PEBAX® (a polyether-block co-polyamide polymer available from Atofina Corporation of Puteaux, France), etc.), and the like, and of any desired thickness and/or varying thicknesses (e.g., 0.25 mm to 5 mm) without departing from this invention. Of course, not all footwear structures will include an inner sole board member of the type illustrated in FIGS. 5 and 5A.

In at least some example sole structures 100 according to the invention, the sole structure 100 further may include a midsole or other impact-attenuating element 520 (see also FIG. 5B) engaged with the innersole board 510 (if any), the interior surface 104 of the sole structure 100, and/or the impact-attenuating member 124 of the sole structure 100. The midsole or other impact-attenuating element(s) 520 may be located on the exterior of the overall footwear structure, within the footwear interior, and/or in any desired location(s), including as conventional structures and/or at conventional location(s) known and used in the art, without departing from this invention (interior midsole members often are used in combination with an inner sole board structure, e.g., of the type illustrated in FIGS. 5 and 5A, often in more "dress" or "saddle" shoe style footwear structures, while exterior midsoles often are used in more "athletic" or "sneaker" style footwear structures, typically without an inner sole board). If desired, as shown in FIGS. 5 and 5B, at least the uppermost surface of the midsole element 520 (e.g., the surface nearest the wearer's foot) also may include lines of flex 522 (e.g, thinned regions, pre-bent, bendable, or kinked regions, open areas or discontinuities, etc.), optionally positioned to correspond to some or all of the lines of flex and recessed regions 108 and 110 of the outsole member's ground-contacting surface 102. If desired, the lower surface of the midsole element 520 also may include lines of flex. The midsole element 520 may provide additional impact-attenuation characteristics, and it may be made from any desired material, such as rubber, polymeric materials (e.g., polyurethane, ethylvinylacetate, phylon, phylite, foams, etc.), and the like, and of any desired thickness and/or of varying thicknesses (e.g., 0.5 mm to 10 mm, and in some examples about 3-8 mm or even 5-6 mm) without departing from this invention.

The footwear structure 500 of this example further includes an upper member 502 engaged with the sole structure 100. Any desired manner of engaging (directly or indirectly) the upper member 502 and the sole structure 100 with one another may be used without departing from the invention, including conventional ways known and used in the art. As a more specific example, as illustrated in FIG. 5, the upper member 502 may be engaged and held between the innersole board 510 and the outsole member 100 and/or between the midsole element 520 and the outsole member 100, e.g., in conventional lasting procedures and/or the like, e.g., using cements, adhesives, stitching, or the like. The upper member 502 may be made of any desired materials and/or combinations of materials without departing from the invention, including conventional materials known and used in the art, such as one or more of fabrics, leathers, polymeric materials, rubber materials, etc.

The upper member 502 may contain any desired number of pieces and/or may be made in any desired construction without departing from the invention, including in conventional constructions known and used in the art. The footwear structure 500 also may include additional structures or elements, including conventional structures and/or elements known and used in the art, such as securing systems (e.g., laces, buckles, hook-and-loop fasteners, zippers, etc.); heel counters; insole members; interior booties; sock liners; additional impact-attenuating elements; gas-filled bladders; impact-attenuating foam columns; etc.

In use, aspects and features of this invention can help wearers maintain a high level and degree of surface area contact with the ground in a variety of different situations, such as when making a swinging action, when stepping or otherwise moving (even on hilly or uneven terrain), and/or at other times when a wearer shifts his/her weight and/or change his/her center of gravity while wearing the article of footwear 500. For example, when standing still on level ground (e.g., at the start of a golf swing), a wearer's weight may be relatively evenly distributed over his/her feet (e.g., on the center or balls of the feet). As the wearer begins a golf swing (or other swinging action), he/she may begin to shift his/her weight to the sides and/or front of the foot (e.g., toward the medial side for the front foot and toward the lateral side for the rear foot during a golf swing). As the center of gravity or weight shifts across the interior of the sole structure 100, the individual sections and/or sub-sections of the sole member 100 may move (e.g., rotate or move somewhat with respect to one another about the lines of flex 108 and/or 110) such that the entire sole member 100 does not lose contact with the ground at one time and/or at an early time in the overall swing process.

More specifically, as noted above, during the beginning portion of a golf swing (the backswing), the player's weight may shift toward the medial side of the front foot and toward the lateral side of the rear foot. Because the front portion of the front foot's sole structure 100 can move about the recessed segment 108 as the weight shifts toward the medial side of the front foot, the lateral portion of that sole structure 100 can leave the ground if necessary (due to the flexibility of the sole structure 100 about recessed segment 108) while the medial portions of the sole structure 100 maintain good contact with the ground. The flexibility of the sole structure 100 can help keep the medial side on the ground for a longer time, e.g., as the wearer moves into the ball during a downswing (thereby providing solid support for the downswing and ball contact phases of a typical swing). Similarly, for the rear foot, because the front portion of the rear foot's sole structure 100 can move about the recessed segment 108 as the weight shifts toward the lateral side of the rear foot, the medial portion of the sole structure 100 can leave the ground if necessary (due to the flexibility of the sole structure 100 about recessed segment 108) while the lateral portions of the sole structure 100 maintain good contact with the ground. The heel portion of the foot also may be made to be movable or rotatable about recessed segment 108 as the player's weight shifts.

As the swing transitions from a backswing to a forward swing, the player's weight and/or center of gravity may shift in the shoes back toward the center and toward the shoes' opposite sides (e.g., in at least some swing sequences, a twisting force will be applied with its axis generally running through a central portion of the wearer's foot or leg). By providing the substantially perpendicular walls 132 facing the front lateral side of the wearer's foot and the substantially perpendicular walls 142 facing the rear medial side of the wearer's foot, a wearer can get good traction to support pushing off during the golf swing (e.g., the substantially perpendicular walls 132 and 142 can engage the ground and provide a relatively solid base for the swing). Additionally, movement of the various portions of the sole structure 100 about recessed segment 108 (and/or 110) can help maintain more of the sole structure 100 in contact with the ground as the weight shift occurs during the downswing and follow-through actions.

The traction elements 160 on the front portion of the sole structure 100 help maintain traction when a wearer is moving or standing on uphill terrain (e.g., because a wearer typically will lean forward and/or put more weight on his/her toes to help maintain his/her balance, the substantially perpendicular walls 162 will engage the ground and help provide traction). In a similar manner, the rear traction elements 150 at the heel portion of the sole structure help maintain traction when a wearer is moving or standing on downhill terrain (e.g., because a wearer typically will lean backward and/or put more weight on his/her heels to help maintain his/her balance, the substantially perpendicular walls 152 will engage the ground and help provide traction). Additionally, because of the weight shift from front to rear and vice versa (e.g., during step and landing activities while walking, running, swinging, etc.), movement of some portions of the sole structure 100 with respect to other portions thereof about the lateral recessed segments 110 enables more of the sole structure 100 to stay in contact with the ground (e.g., as compared to the degree of contact with a non-flexible and/or stiff outsole structure), in a manner similar to that described above for the longitudinal recessed segments 108.

Notably, the various specific example sole structures illustrated and described in this specification include: (a) rotation-inhibiting elements on the lateral side (e.g., lateral of the longitudinal line of flex) and (b) ground-penetrating elements on the medial side (e.g., medial of the longitudinal line of flex). These features can be useful, for example, because during a golf swing (or other swinging actions), users tend to apply downward pressure on the medial side of the foot and rotational force on the lateral side of the foot. Therefore, ground-penetrating traction elements on the medial side of the shoe sole (e.g., having a greater height dimension than a base dimension, as described above) can help provide good downward pressing support and traction during certain parts of a swing, and rotation-inhibiting elements on the lateral side of the shoe sole (e.g., having a side facing wall and/or a height less than at least one of the base width or length dimensions) can help provide good rotational support and traction during certain parts of a swing. Of course, additional and/or alternative locations for ground-penetrating traction elements, rotation-inhibiting traction elements, and/or other traction element structures are possible without departing from this invention.

Additionally, in the illustrated example sole structures, the various traction element structures are provided at locations on the sole structure suitable for both the front foot and the rear foot, e.g., with respect to the typical forces applied to a foot and shoe during a golf swing. In other words, each shoe of a pair has the same general sole structure (mirror images of one another). Of course, if desired, further refinements to the sole structures and the various traction element structures and locations thereon may be made to further optimize the traction element structures and locations specific for the front and rear feet (e.g., during a golf swing or other activities). In such situations, different golf shoes (or other sport or activity specific shoes) or combinations of golf shoes may be provided for right-handed and left-handed players. In other words, each shoe of a pair need not include a sole structure that is a mirror image of the sole structure on the mating shoe of the pair. Footwear pairs having different traction element structures and arrangements for the right and left feet may be provided in accordance with at least some examples of this invention.

Also, as illustrated in the various figures, sole structures in accordance with examples of this invention may be both "spiked" and "spikeless" (e.g., both including metal or plastic removable spike or cleat elements as shown in FIGS. 2A, 2B, 3, and 4, and omitting such structures as shown in FIGS. 1A through 1C).

Features and aspects of this invention may be applied to a wide variety of shoes or other foot-receiving devices, particularly shoes and other foot-receiving devices used when a swinging motion is made (e.g., golf shoes, baseball or softball shoes, cricket shoes, field hockey shoes, devices for holding the feet used in video game play, etc.).

D. Conclusion

While the invention has been described with respect to specific examples including presently preferred modes of carrying out the invention, those skilled in the art will appreciate that there are numerous variations, combinations, and permutations of the above described structures. Moreover, various specific structural features included in the above examples merely represent examples of structural features that may be included in some examples of structures according to the invention. Those skilled in the art will understand that various specific structural features may be omitted and/or modified in a footwear or other foot-receiving device product without departing from the invention. Thus, the reader should understand that the spirit and scope of the invention should be construed broadly as set forth in the appended claims.

We claim:

1. A sole structure, comprising:

an outsole member including an exterior surface and an interior surface, wherein the exterior surface includes:

a first recessed segment extending toward the interior surface and in a longitudinal direction from a forefoot portion to a heel portion of the outsole member, wherein the first recessed segment provides a line of flex in the outsole member and divides the outsole member into a medial side and a lateral side, wherein the medial and lateral sides are movable about the line of flex to independently engage and disengage from a contact surface as a dynamic force moves laterally across the interior surface, plural lateral motion inhibiting traction elements extending from the exterior surface in the forefoot portion of the lateral side of the outsole member, each lateral motion inhibiting traction element including a substantially perpendicular wall facing the lateral side and a sloped wall extending from the wall toward the exterior surface, and plural medial motion inhibiting traction elements extending from the exterior surface in the heel portion of the lateral side of the outsole member, each medial motion inhibiting traction element including a substantially perpendicular wall facing the medial side and a sloped wall extending from the wall toward the exterior surface.

2. A sole structure according to claim 1, wherein the outsole member further includes plural ground penetrating traction elements extending from the exterior surface in the forefoot portion of the medial side and plural ground penetrating traction elements extending from the exterior surface in the heel portion of the medial side.

3. A sole structure according to claim 2, wherein at least some of the ground penetrating traction elements have a height dimension greater than their base length and base width dimensions.

4. A sole structure according to claim 1, wherein the exterior surface further includes a second recessed segment extending toward the interior surface and in a lateral direction in the forefoot portion of the outsole member.

5. A sole structure according to claim 4, wherein the exterior surface further includes a third recessed segment extending toward the interior surface and in the lateral direction in the heel portion of the outsole member.

6. A sole structure according to claim 4, wherein the exterior surface further includes a third recessed segment extending toward the interior surface and in the lateral direction in the forefoot portion of the outsole member.

7. A sole structure according to claim 1, further comprising:

a first material at least partially filling the first recessed segment, wherein the first material is softer than a material making up a major portion of the outsole member.

8. A sole structure according to claim 1, wherein at least some of the lateral motion inhibiting traction elements have a height dimension less than at least one of their base length or base width dimensions.

9. A sole structure according to claim 1, wherein at least some of the medial motion inhibiting traction elements have a height dimension less than at least one of their base length or base width dimensions.

10. A sole structure according to claim 1, wherein the outsole member constitutes a golf shoe outsole.

11. A sole structure, comprising:

an outsole member including an exterior surface and an interior surface, wherein the exterior surface includes a first recessed segment extending toward the interior surface and in a longitudinal direction from a forefoot portion to a heel portion of the outsole member, wherein the first recessed segment provides a line of flex in the outsole member and divides the outsole member into a medial side and a lateral side, wherein the medial and lateral sides are movable about the line of flex to independently engage and disengage from a contact surface as a dynamic force moves laterally across the interior surface, and wherein a lateral side of the sole structure is less flexible than a medial side of the sole structure; and plural lateral motion inhibiting traction elements extending from the exterior surface in the forefoot portion of the lateral side of the outsole member, each lateral motion inhibiting traction element including a substantially perpendicular wall facing the lateral side and a sloped wall extending from the wall toward the exterior surface.

12. A sole structure according to claim 11, wherein the exterior surface further includes a second recessed segment extending toward the interior surface and in a lateral direction in the forefoot portion of the outsole member.

13. A sole structure according to claim 12, wherein the exterior surface further includes a third recessed segment extending toward the interior surface and in the lateral direction in the heel portion of the outsole member.

14. A sole structure according to claim 12, wherein the exterior surface further includes a third recessed segment extending toward the interior surface and in the lateral direction in the forefoot portion of the outsole member.

15. A sole structure according to claim 11, further comprising:

an impact-attenuating member engaged with the outsole member, wherein the impact-attenuating member is located at least at the heel portion of the outsole member.

16. A sole structure according to claim 15, wherein the impact-attenuating member includes a gas-filled bladder.

17. A sole structure according to claim 16, wherein the gas-filled bladder is contained, at least in part, in a first retaining structure located along the lateral side of the sole structure and a second retaining structure located along the medial side of the sole structure, wherein the first retaining structure is less flexible than the second retaining structure.

18. A sole structure according to claim 15, wherein the lateral side of the sole structure is made less flexible than the medial side of the sole structure, at least in part, by constructing at least a portion of a lateral side of the impact-attenuating member from a material that is less flexible than a material from which at least a portion of a medial side of the impact-attenuating member is constructed.

19. A sole structure according to claim 11, wherein the lateral side of the sole structure is made less flexible than the medial side of the sole structure, at least in part, by constructing at least a portion of the lateral side of the outsole member from a material that is less flexible than a material from which at least a portion of the medial side of the outsole member is constructed.

20. A sole structure according to claim 11, wherein the lateral side of the sole structure is made less flexible than the medial side of the sole structure, at least in part, by engaging an auxiliary support element with the lateral side of the outsole member.

21. A sole structure according to claim 11, wherein the outsole member constitutes a golf shoe outsole.

22. An article of footwear, comprising:

an upper member; and a sole structure engaged with the upper member, wherein the sole structure includes an outsole member having an exterior surface and an interior surface, wherein the exterior surface includes:

a first recessed segment extending toward the interior surface and in a longitudinal direction from a forefoot portion to a heel portion of the outsole member, wherein the first recessed segment provides a line of flex in the outsole member and divides the outsole member into a medial side and a lateral side, wherein the medial and lateral sides are movable about the line of flex to independently engage and disengage from a contact surface as a dynamic force moves laterally across the interior surface, plural lateral motion inhibiting traction elements extending from the exterior surface in the forefoot portion of the lateral side of the outsole member, each lateral motion inhibiting traction element including a substantially perpendicular wall facing the lateral side and a sloped wall extending from the wall toward the exterior surface, and plural medial motion inhibiting traction elements extending from the exterior surface in the heel portion of the lateral side of the outsole member, each medial motion inhibiting traction element including a substantially perpendicular wall facing the medial side and a sloped wall extending from the wall toward the exterior surface.

23. An article of footwear according to claim 22, wherein the outsole member further includes plural ground penetrating traction elements extending from the exterior surface in the forefoot portion of the medial side and plural ground penetrating traction elements extending from the exterior surface in the heel portion of the medial side.

24. An article of footwear according to claim 23, wherein at least some of the ground penetrating traction elements have a height dimension greater than their base length and base width dimensions.

25. An article of footwear according to claim 22, wherein the exterior surface further includes a second recessed segment extending toward the interior surface and in a lateral direction in the forefoot portion of the outsole member.

26. An article of footwear according to claim 25, wherein the exterior surface further includes a third recessed segment extending toward the interior surface and in the lateral direction in the forefoot portion of the outsole member.

27. An article of footwear according to claim 22, further comprising:

a first material at least partially filling the first recessed segment.

28. An article of footwear according to claim 27, wherein the first material is softer than a material making up a major portion of the outsole member.

29. An article of footwear according to claim 22, further comprising:

an impact-attenuating member engaged with the outsole member, wherein the impact-attenuating member is located at least at the heel portion of the outsole member.

30. An article of footwear according to claim 22, wherein at least some of the lateral motion inhibiting traction elements have a height dimension less than at least one of their base length or base width dimensions.

31. An article of footwear according to claim 22, wherein at least some of the medial motion inhibiting traction elements have a height dimension less than at least one of their base length or base width dimensions.

32. An article of footwear according to claim 22, wherein the article of footwear constitutes a golf shoe.

33. An article of footwear, comprising:

an upper member; and a sole structure engaged with the upper member, wherein the sole structure includes an outsole member having an exterior surface and an interior surface, wherein the exterior surface includes a first recessed segment extending toward the interior surface and in a longitudinal direction from a forefoot portion to a heel portion of the outsole member, wherein the first recessed segment provides a line of flex in the outsole member and divides the outsole member into a medial side and a lateral side, wherein the medial and lateral sides are movable about the line of flex to independently engage and disengage from a contact surface as a dynamic force moves laterally across the interior surface, and wherein a lateral side of the sole structure is less flexible than a medial side of the sole structure; and plural lateral motion inhibiting traction elements extending from the exterior surface in the forefoot portion of the lateral side of the outsole member, each lateral motion inhibiting traction element including a substantially perpendicular wall facing the lateral side and a sloped wall extending from the wall toward the exterior surface.

34. An article of footwear according to claim 33, wherein the exterior surface further includes a second recessed segment extending toward the interior surface and in a lateral direction in the forefoot portion of the outsole member.

35. An article of footwear according to claim 34, wherein the exterior surface further includes a third recessed segment extending toward the interior surface and in the lateral direction in the forefoot portion of the outsole member.

36. An article of footwear according to claim 33, further comprising:

an impact-attenuating member engaged with the outsole member and located at least at the heel portion of the outsole member.

37. An article of footwear according to claim 36, wherein the impact-attenuating member includes a gas-filled bladder.

38. An article of footwear according to claim 37, wherein the gas-filled bladder is contained, at least in part, in a first retaining structure located along the lateral side of the sole structure and a second retaining structure located along the medial side of the sole structure, wherein the first retaining structure is less flexible than the second retaining structure.

39. An article of footwear according to claim 36, wherein the lateral side of the sole structure is made less flexible than the medial side of the sole structure, at least in part, by constructing at least a portion of a lateral side of the impact-attenuating member from a material that is less flexible than a material from which at least a portion of a medial side of the impact-attenuating member is constructed.

40. An article of footwear according to claim 33, wherein the lateral side of the sole structure is made less flexible than the medial side of the sole structure, at least in part, by constructing at least a portion of the lateral side of the outsole member from a material that is less flexible than a material from which at least a portion of the medial side of the outsole member is constructed.

41. An article of footwear according to claim 33, wherein the lateral side of the sole structure is made less flexible than the medial side of the sole structure, at least in part, by engaging an auxiliary support element with the lateral side of the outsole member.

42. An article of footwear according to claim 33, wherein the article of footwear constitutes a golf shoe.

* * * * *

UNITED STATES PATENT AND TRADEMARK OFFICE

CERTIFICATE OF CORRECTION

PATENT NO. : 7,650,707 B2
APPLICATION NO. : 11/360993
DATED : January 26, 2010
INVENTOR(S) : Campbell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 984 days.

Signed and Sealed this

Twenty-third Day of November, 2010

David J. Kappos

David J. Kappos
*Director of the United States Patent and Trademark Office*